United States Patent [19]

Palmer

[11] Patent Number: 5,064,966

[45] Date of Patent: Nov. 12, 1991

[54] MULTIPLE SEGMENT AUDIO CABLE FOR HIGH FIDELITY SIGNALS

[76] Inventor: Donald E. Palmer, 1275 Vicente Dr. #189, Sunnyvale, Calif. 94086

[21] Appl. No.: 597,140

[22] Filed: Oct. 15, 1990

[51] Int. Cl.[5] ..... H01B 11/00

[52] U.S. Cl. ..... 174/32; 174/34

[58] Field of Search ..... 174/32, 33, 34, 36; 307/89, 91

[56] References Cited

U.S. PATENT DOCUMENTS

| | | | |
|---|---|---|---|
| 4,413,304 | 11/1983 | Gerry | 361/253 |
| 4,558,392 | 12/1985 | Gerry | 361/253 |
| 4,590,536 | 5/1986 | Gerry | 361/253 |
| 4,593,153 | 6/1986 | Kahn et al. | 174/34 |
| 4,754,102 | 6/1988 | Dzurak | 174/36 |
| 4,885,555 | 12/1989 | Palmer | 174/32 X |
| 4,939,315 | 7/1990 | Palmer | 174/36 |
| 4,945,189 | 7/1990 | Palmer | 174/32 |

*Primary Examiner*—Morris H. Nimmo

*Attorney, Agent, or Firm*—Townsend and Townsend

[57] ABSTRACT

An interconnection cable for audio frequency high fidelity applications, such as loudspeakers, is provided wherein a first wire and a second wire extend between a reference end and a terminal end, the second or auxiliary wire being divided into two serial segments by a single electrical discontinuity separating each segment, wherein each segment is conductively terminated at its respective end in a signal common or ground with the first wire, and wherein the electrical discontinuity is at between 9/16 and 23/32 of the distance from a reference end. Multiple interconnection cables may be assembled into balanced transmission lines for a signal path and a signal return. It is preferable that the reference end be at the signal source and the terminal end is at the signal load.

8 Claims, 1 Drawing Sheet

MULTIPLE SEGMENT AUDIO CABLE FOR HIGH FIDELITY SIGNALS

REFERENCE TO RELATED PATENT

This invention relates to U.S. Pat. No. 4,939,315, issued July 3, 1990, to Donald E. Palmer.

BACKGROUND OF THE INVENTION

The present invention relates generally to audio high fidelity cables or transmission lines wherein the wavelength of signals carried on the transmission lines are generally longer than the length of the transmission lines, such as in audio signal and high fidelity sound reproduction applications. The invention has particular application where the range of frequencies is greater than several octaves and therefore wherein spurious oscillations (ringing) and broadband random noise carried on the transmission line can have potentially significant impact on the fidelity of a complex signal carried by the transmission line.

In contrast to long transmission lines where the impedance of the cable is matched to the impedance of the termination loads, it is conventional in short transmission lines to reduce the impedance, and more particularly the resistance, of the cable to a minimum to reduce the electrical resistive loss in the cable. When used in high fidelity audio signal interconnection cabling, as between components in an audio component system, such an approach introduces secondary problems, such as audible enhancement of the "brightness" frequencies (1000 Hz to 2000 Hz range) and can cause distortion in the desired audio frequency signals. The primary causes of these effects appear to be radio-frequency noise and spurious oscillation (ringing) in the interconnect cables.

It is common practice in audio frequency circuitry to provide a twisted pair of signal conductors as a cable between the output of the audio amplifier and the loudspeaker loads. A typical configuration is a twisted pair of conductors in which one of the conductors is used as signal path and the other is used as a signal return path. Designation of the signal path and the signal return may be arbitrary.

Noise which is internally generated in audio equipment can couple into the audio cable, which can cause a spurious oscillation (ringing) of an electromagnetic nature in the cable. The added noise and resultant ringing on the cable can modulate the signal and can couple into the feedback circuit of the output amplifier, causing distortion in the signal. This coupling is aggravated where the length of the two conductive signal leads are substantially equal. Thus the natural length-wise mode of ringing in each element is nearly identical, which can result in common mode noise. This is an undesirable condition.

It appears further that radio frequency sources can induce distortion in audio signals carried over leads of an unshielded cable. The sources may be either internal (in an amplifier for example) or external (in a television set). The effects of radio frequency noise on audio frequency signals appear to be most pronounced at the higher audio frequencies, where distortion has been noted. The presence of oscillations and modal resonances in cables is believed to result in undesired enhancement in the "brightness" frequencies (1000 Hz to 2000 Hz range). These effects are undesirable if accurate reproduction of recorded music and the like is desired.

A solution to some of the problems in faithful transmission of a signal through a cable has been proposed in U.S. Pat. No. 4,754,102 issued June 28, 1988, to T.J. Dzurak. Therein a directional transmission cable is disclosed which has a plurality of insulated conductive wires, wherein at one termination all of the collection of wires are connected together and at the opposing termination less than all of the collection of wires are connected together. The unconnected wire or wires run the entire length of the cable.

SUMMARY OF THE INVENTION

According to the invention, an interconnection cable for audio frequency high fidelity applications, such as loudspeakers, is provided wherein a first wire and a second wire extend between a reference end and a terminal end, the second or auxiliary wire being divided into two serial segments by a single electrical discontinuity separating each segment, wherein each segment is terminated at its respective end in a signal common with the first wire, and wherein the electrical discontinuity is at between 9/16 and 23/32 of the distance from a reference end. Multiple interconnection cables may be assembled into balanced transmission lines for a signal path and a signal return. It is preferable that the reference end be at the signal source and the terminal end is at the signal load.

The purpose of the discontinuity is to provide several electrically connected and closely coupled conductor segments in which the lengthwise natural ringing modes of the sequel path and the auxiliary conductors have a minimum number of similar frequencies.

It is undesirable to have multiple conductor cables where all the conductors run the full length of the cable. In this condition, all of the conductors have similar fundamental and higher order lengthwise natural ringing modes. The cable disclosed in the present invention is less susceptible to lengthwise common mode ringing than cables wherein all the conductors are nearly the same length.

The invention will be better understood by reference to the following detailed description taken in conjunction with the accompanying drawings.

DESCRIPTION OF SPECIFIC EMBODIMENTS

Figure 1:
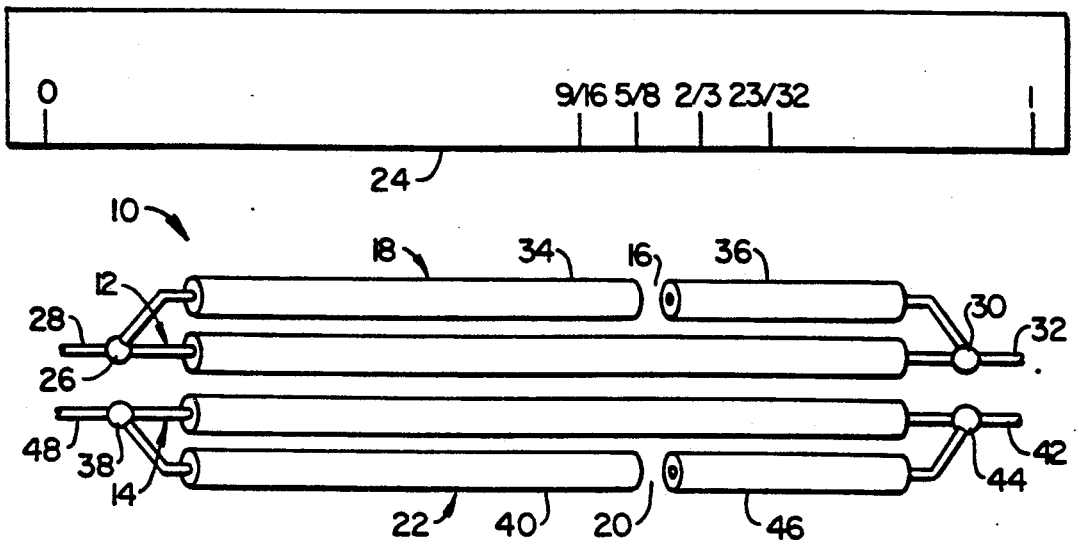
FIG. 1 is a perspective view in schematic form of a balanced transmission line constructed in accordance with the invention showing positioning of a discontinuity in auxiliary wires and showing a scale indicating position ranges for said discontinuity.

Referring to FIG. 1, there is shown a perspective view in schematic form of a balanced transmission line 10 constructed in accordance with the invention having a first conductor lead 12 and a second conductor lead 14 and showing positioning of a discontinuity 16 in a first auxiliary wire 18. In addition there is a discontinuity 20 in a second auxiliary wire 22 and a scale 24 indicating position ranges for the discontinuities 16 and 20. The first insulated electrically-conductive lead 12 is for carrying signals intended primarily for the audio range and the second electrically-conductive lead 14 disposed adjacent the lead 12 is for carrying return signals.

According to the invention, the first conductive lead 12 has a connection 26 to the first auxiliary wire 18 at a reference end 28 and a connection 30 to the first auxiliary wire 18 at a terminal end 32. Further according to the invention, the electrical discontinuity 16 in the auxiliary wire 18 is at a preselected distance from the reference end 28 of the cable 10 forming thereby a first segment 34 and a second segment 36. The discontinuity 16 may be a space or like electrical separation of on the order of ¼ inch or less. An identical arrangement is provided in the parallel conductor comprising a reference end 48, a connection 38 to a first segment 40, a terminal end 42 and a connection 44 to a second segment 46.

According to the invention, the electrical discontinuity 16 of the first auxiliary conductor 18 and the electrical discontinuity 20 of the second auxiliary conductor 22 is at between 9/16 and 23/32 of the distance from the reference end 28 or 36, respectively. It is preferable that the reference ends 28, 48 be at the signal source and the terminal ends 32, 42 be at the signal load when installed as signal carrying conductors between components or subsystems in an audio system.

The placement of the discontinuities 16 and 20 is important. Each location of the discontinuities 16 and 20 along the lengths of the cable 10 will vary the lengths of the first segments 34 and 40 and the second segments 36 and 46 while the length of the signal leads 12 and 14 remain the same. Therefore, the relationships of the lengthwise natural ringing modes in the signal leads 12 and 14, the first segments 34 and 40, and the second segments 36 and 46 will be different for each location of the discontinuities 16 and 20. The optimum location may need to be determined empirically and can be dependant on the sonic results desired.

It has been discovered that the desired effects are not achieved for a discontinuity 16 which is disposed at less than 9/16 or greater than 23/32 of the distance from the reference end 22. As the length of the longer segment 18 is increased above 72%, it approaches the length of the lead 12, which may result in resonance therebetween. As the length of either segment 18 or 20 approaches 50% of the length of the lead 12, both segments 18 and 20 approach half-wave (second harmonic) resonance with the lead 12. Thus, noise and ringing suppression is apparent for a single discontinuity placed in the distance range 9/32 to 7/16 and 9/16 to 23/32 along the length of the cable.

Figure 2:
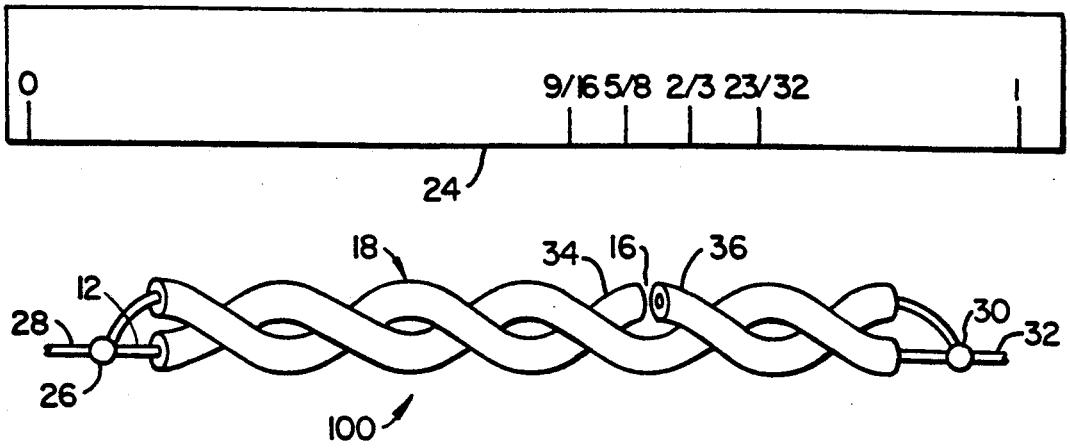
FIG. 2 is a perspective view of a single conductor dual-wire line twisted as a pair in accordance with the invention.

Referring to FIG. 2, there is shown a perspective view of a single signal, dual conductor cable 100 constructed in accordance with the invention. The numbering in FIG. 2 corresponds to the numbering of the first conductor pair 12, 18 of FIG. 1. In the embodiment of FIG. 2, the second or auxiliary lead 18 may be twisted around the first lead 12. The placement of the discontinuity 16 in the auxiliary lead 18 is selected as in the placement of the discontinuity 16 for the embodiment of FIG. 1.

The invention has now been explained with reference to specific embodiments. Other embodiments will be apparent to those of ordinary skill in this art in light of this disclosure. Therefore, it is not intended that this invention be limited except as indicated by the appended claims.

What is claimed is:

1. An interconnection cable for audio frequency high fidelity applications comprising:

a first wire having a reference end and a terminal end;

a second wire, said second wire being divided into a first segment and a second segment by a single electrical discontinuity separating said first segment from said second segment, wherein said first segment is conductively terminated at said reference end and said second segment is conductively terminated at said terminal end, and wherein the electrical discontinuity is at between 9/16 and 23/32 of the distance from said reference end.

2. The apparatus according to claim 1 wherein said first wire is one signal lead which is continuous throughout the length of the cable.

3. The apparatus according to claim 2 wherein the reference end is at the signal source and the terminal end is at the signal load.

4. The apparatus according to claim 1 wherein the reference end is at the signal source and the terminal end is at the signal load.

5. The apparatus according to claim 1 wherein the first wire and the second wire are twisted about one another.

6. The apparatus according to claim 1 further including a third wire with a reference end and a terminal end and a fourth wire, said fourth wire being divided into a third segment and a fourth segment by a single electrical discontinuity separating said third segment from said fourth segment, wherein said third segment is conductively terminated at said reference end and said fourth segment is conductively terminated at said terminal end, and wherein the electrical discontinuity is at between 9/16 and 23/32 of the distance from said reference end.

7. The apparatus according to claim 6 wherein said third wire is a second signal lead which is continuous throughout the length of the cable.

8. An interconnection cable for audio frequency high fidelity applications comprising:

a first conductive lead, wherein said first conductive lead comprises:

a first wire having a reference end and a terminal end; and a second wire, said second wire being divided into a first segment and a second segment by a single electrical discontinuity separating said first segment from said second segment, wherein said first segment is conductively terminated at said reference end and said second segment is conductively terminated at said terminal end, and wherein the electrical discontinuity is at between 9/16 and 23/32 of the distance from said reference end; and a second insulated conductive lead, wherein said second conductive lead comprises:

a third wire with a reference end and a terminal end and a fourth wire, said fourth wire being divided into a third segment; and a fourth segment by a single electrical discontinuity separating said third segment from said fourth segment, wherein said third segment is conductively terminated at said reference end and said fourth segment is conductively terminated at said terminal end, and wherein the electrical discontinuity is at between 9/16 and 23/32 of the distance from said reference end.

* * * * *